US008002649B2

(12) United States Patent
Forrest, Sr.

(10) Patent No.: US 8,002,649 B2
(45) Date of Patent: Aug. 23, 2011

(54) BLOCKING SLED WITH PIVOTABLE AUXILIARY PAD

(76) Inventor: Charles P. Forrest, Sr., Spanish Fort, AL (US)

( * ) Notice: Subject to any disclaimer, the term of this patent is extended or adjusted under 35 U.S.C. 154(b) by 0 days.

(21) Appl. No.: 12/929,092

(22) Filed: Dec. 30, 2010

(65) Prior Publication Data

US 2011/0165972 A1 Jul. 7, 2011

Related U.S. Application Data

(60) Provisional application No. 61/335,186, filed on Jan. 4, 2010.

(51) Int. Cl.
*A63B 69/34* (2006.01)

(52) U.S. Cl. ..... 473/445

(58) Field of Classification Search ..... 473/441–445; 482/83–90

See application file for complete search history.

(56) References Cited

U.S. PATENT DOCUMENTS

| | | | | | |
|---|---|---|---|---|---|
| 2,162,073 | A * | 6/1939 | Evans | 473/442 |
| 2,967,709 | A * | 1/1961 | Stahley | 473/441 |
| 3,062,547 | A * | 11/1962 | Kopp | 473/441 |
| 3,425,692 | A * | 2/1969 | Leach | 473/445 |
| 3,514,105 | A * | 5/1970 | Pillard | 473/441 |
| 3,637,210 | A * | 1/1972 | Brantley | 473/443 |
| 3,684,283 | A * | 8/1972 | Forrest | 473/445 |
| 3,827,690 | A * | 8/1974 | Rogers | 473/445 |
| 4,087,089 | A * | 5/1978 | Forrest | 473/445 |
| 4,140,315 | A * | 2/1979 | Page, Jr. | 473/445 |
| 4,477,076 | A * | 10/1984 | Monaco | 473/441 |
| 4,508,341 | A * | 4/1985 | Carrington | 473/441 |
| 5,013,039 | A * | 5/1991 | Cole | 473/445 |
| 5,385,523 | A * | 1/1995 | Forrest | 473/445 |
| 5,462,272 | A * | 10/1995 | Staten | 473/445 |
| 6,599,206 | B1 * | 7/2003 | Forrest et al. | 473/441 |
| 6,685,581 | B2 * | 2/2004 | Krause et al. | 473/445 |
| 6,761,650 | B1 * | 7/2004 | Dettmann | 473/445 |
| 6,942,585 | B1 * | 9/2005 | Krause | 473/445 |
| 2002/0147061 | A1 * | 10/2002 | Krause et al. | 473/445 |
| 2006/0046875 | A1 * | 3/2006 | Forrest | 473/441 |
| 2008/0051228 | A1 * | 2/2008 | Harmon et al. | 473/445 |
| 2008/0119306 | A1 * | 5/2008 | Gamboa | 473/444 |

* cited by examiner

*Primary Examiner* — Mark S Graham
(74) *Attorney, Agent, or Firm* — H. Jay Spiegel

(57) ABSTRACT

A blocking sled includes a first main blocking pad reciprocable on a frame between extended and retracted positions. When a lineman hits the main blocking pad, it is moved to the position of retraction and when the lineman releases the pad, it extends back to its original un-retracted position. In association with each main blocking pad, an auxiliary pad is provided that in one position closely overlies and extends forward of the main blocking pad in its extended position. The auxiliary blocking pad is pivotably mounted to the frame and is latched in the position closely overlying and extending forward of the main blocking pad. An actuator facilitates release of a latching mechanism for the auxiliary pad and moves along with a support rod for the main blocking pad. When the rod is reciprocated, eventually it engages the latch of the auxiliary pad and releases that latch causing a biasing means to pivot the auxiliary pad up and forward with respect to its position when latched. In the latched position of the auxiliary pad, it is so positioned that it forces a blocker to lower their center of gravity and bend down and forward to enable them to engage the main blocking pad while passing under the auxiliary pad. Once the main blocking pad has been reciprocated to its retracted position, the auxiliary pad pivots upward and forward of the main blocking pad so the blocker can lift up and complete the block in a manner simulating play in an actual football game.

20 Claims, 10 Drawing Sheets

BLOCKING SLED WITH PIVOTABLE AUXILIARY PAD

This application claims priority from Provisional Application Ser. No. 61/335,186, filed Jan. 4, 2010, and titled "747 SLED CHUTE."

BACKGROUND OF THE INVENTION

The present invention relates to a blocking sled with pivotable auxiliary pad. In the prior art, such devices are typically employed by offensive linemen in the game of American football to practice blocking techniques. In particular, such sleds typically include a frame that may glide over a grassy field and a bracket to which is affixed a pad that may be hit by the practicing player. Such a pad may be fixedly mounted to a frame via the bracket or may be movable with respect thereto.

When coaching an offensive lineman or even a running back or receiver in the proper blocking techniques, one technique that is often taught is that the player should maintain a low center of gravity for as long a period of time as possible so that the player has maximum leverage against a player they are blocking. Human nature being what it is, typically, an offensive lineman either practicing blocking techniques or blocking during an actual football game has a tendency to rise up out of their initial three point stance and elevate their center of gravity which reduces their effectiveness.

As such, a need has developed for a blocking sled that will facilitate practicing of blocking techniques including maintenance of a low center of gravity. It is with this need in mind that the present invention was developed.

The following prior art is known to Applicant:

U.S. Pat. No. 3,578,324 to Alvey et al. discloses a football blocking apparatus having a frame with a pad mounted thereon as well as a pivotable arm having a proximal end behind the pad. The present invention differs from the teachings of Alvey et al. as contemplating a blocking sled having a main pad and an auxiliary pad overlying and extending forward of the main pad.

U.S. Pat. No. 3,649,016 to Kelley, Jr. discloses a football blocking trainer including a dummy that may be moved to either side or extended, retracted or swung to simulate movements of an opponent. The present invention differs from the teachings of Kelley, Jr. as contemplating a blocking sled having a main pad and an auxiliary pad overlying and extending forward of the main pad.

U.S. Pat. No. 3,684,283 to Forrest (Applicant herein) discloses a wheeled football training sled having an overhead chute. The overhead chute is vertically adjustable, but has no actuator to move it responsive to movements of the main pad.

U.S. Pat. No. 3,942,796 to Bowen discloses a football practice blocking and tackling reaction machine in which a dummy is mounted on a pivotable support. The present invention differs from the teachings of Bowen as contemplating a blocking sled having a main pad and an auxiliary pad overlying and extending forward of the main pad.

U.S. Pat. No. 5,385,523 to Forrest discloses a dual motion blocking sled in which a pad is mounted on a frame that allows the pad to both reciprocate and pivot. The present invention differs from the teachings of Forrest as contemplating a blocking sled having a main pad and an auxiliary pad overlying and extending forward of the main pad.

U.S. Pat. No. 5,462,272 to Staten discloses a football training sled in which a pad is mounted on a spring-biased telescoping support. The present invention differs from the teachings of Staten as contemplating a blocking sled having a main pad and an auxiliary pad overlying and extending forward of the main pad.

U.S. Pat. No. 6,599,206 to Forrest, Sr. et al. discloses a triple reactor linemen trainer in which a plurality of pads are mounted on a frame and certain ones of the pads may be pivoted laterally based upon actuations by an operator. The present invention differs from the teachings of Forrest, Sr. et al. as contemplating a blocking sled having a main pad and an auxiliary pad overlying and extending forward of the main pad.

U.S. Pat. No. 6,685,581 to Krause et al. discloses an athletic training device consisting of a blocking sled having a plurality of pads that are movable against the force of spring bias. The present invention differs from the teachings of Krause et al. as contemplating a blocking sled having a main pad and an auxiliary pad overlying and extending forward of the main pad.

SUMMARY OF THE INVENTION

The present invention relates to a blocking sled with pivotable auxiliary pad. The present invention includes the following interrelated objects, aspects and features:

(1) In a first aspect, the present invention contemplates a sled on which a frame is mounted. The sled and frame may be sized and configured for a single blocking pad arrangement or a multiple blocking pad arrangement.

(2) Concerning each blocking pad arrangement contemplated in accordance with the teachings of the present invention, a first main blocking pad is provided that is reciprocable on the frame between extended and retracted positions. Thus, when a lineman hits the main blocking pad, it is moved to the position of retraction and when the lineman releases the pad, the biasing force of a spring mounted thereon causes the main blocking pad to extend back to its original un-retracted position.

(3) In association with each main blocking pad, an auxiliary pad is provided that in one position closely overlies and extends forward of the main blocking pad in its extended position. The auxiliary blocking pad is pivotably mounted to the frame and is latched in the position closely overlying and extending forward of the main blocking pad.

(4) An actuator is provided that facilitates release of a latching mechanism for the auxiliary pad. The actuator consists of a reciprocating rod that moves along with a support rod for the main blocking pad. When the rod is reciprocated, eventually it engages the latch of the auxiliary pad and releases that latch causing a biasing means to pivot the auxiliary pad up and forward with respect to its position when latched.

(5) In the latched position of the auxiliary pad, it is so positioned that it forces a blocker to lower their center of gravity and bend down and forward to enable them to engage the main blocking pad while passing under the auxiliary pad. Once the main blocking pad has been reciprocated to its retracted position, as that occurs, the actuator for the auxiliary blocking pad releases the latch thereof and the biasing means causes the auxiliary pad to pivot upward and forward of the main blocking pad. In that position, the lineman who was initially keeping their center of gravity low and driving the main blocking pad forward toward its retracted position can now lift up and complete the block in a manner simulating play in an actual football game.

Accordingly, it is a first object of the present invention to provide a blocking sled with pivotable auxiliary pad.

It is a further object of the present invention to provide such a device in which each set of blocking pads includes a main blocking pad and a pivotable auxiliary blocking pad.

It is a further object of the present invention to provide such a device in which the auxiliary blocking pad is latched in a position forward of and overlying the main blocking pad and moves up and rearward of the main blocking pad when it is unlatched.

It is a still further object of the present invention to provide such a device that facilitates teaching proper blocking techniques including maintenance of a low center of gravity.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
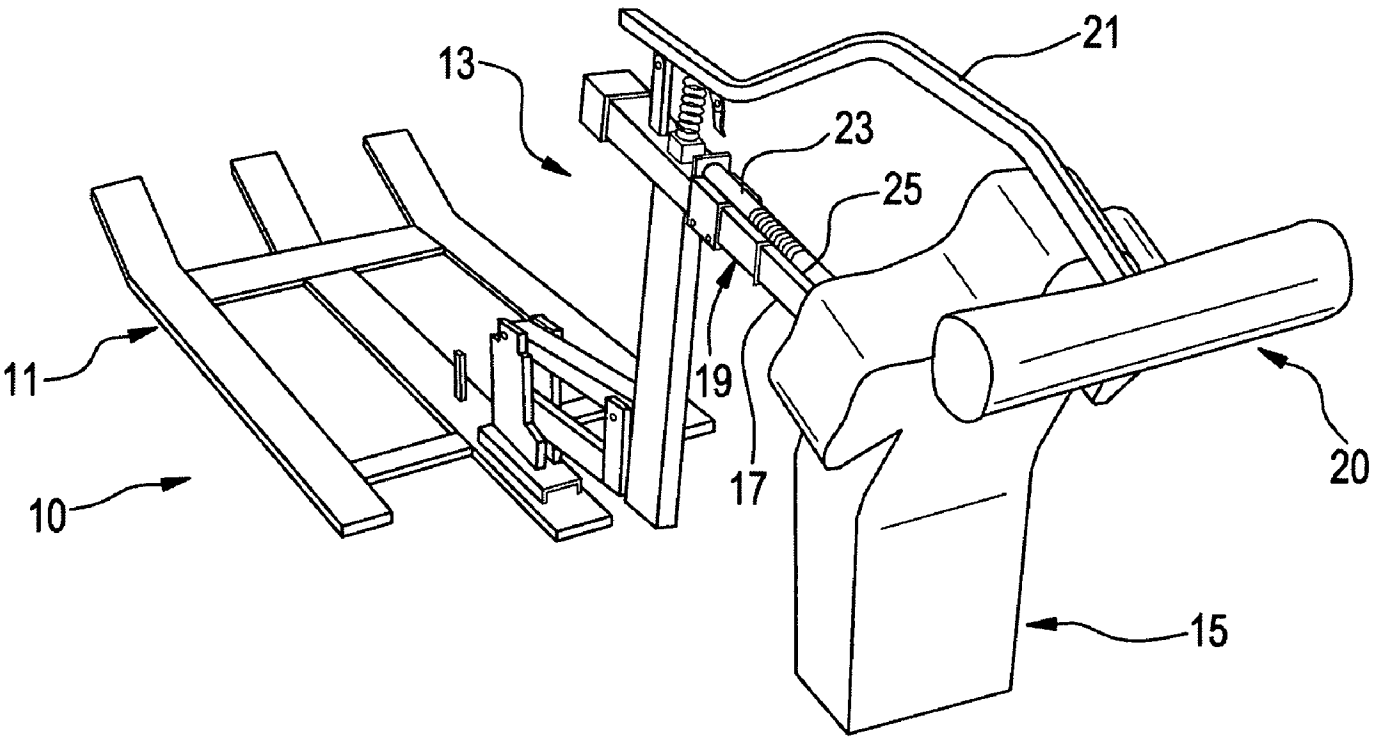
FIG. 1 shows a front side perspective view of a blocking sled having a single station and the auxiliary pad thereof in a first position.
Figure 2:
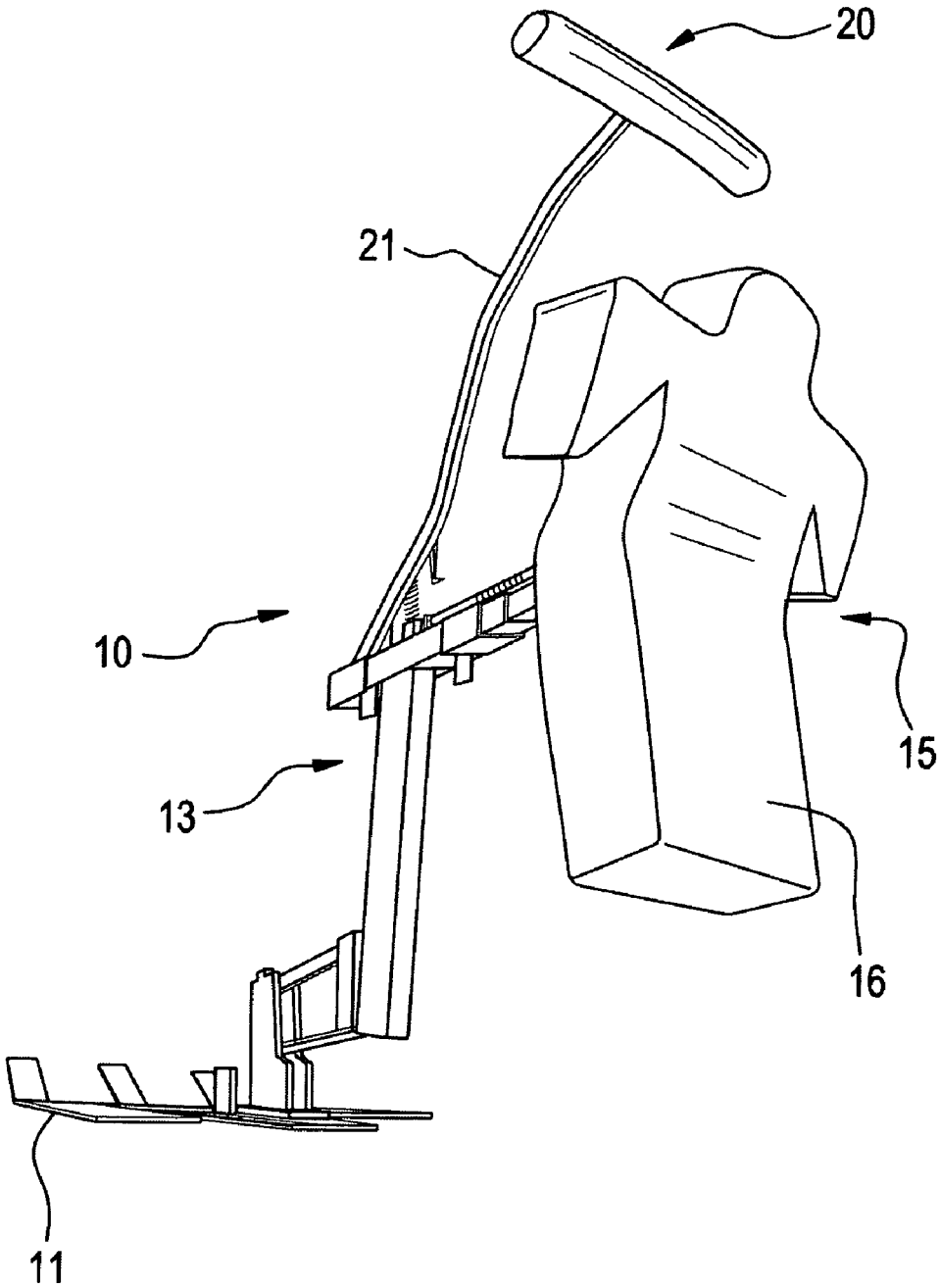
FIG. 2 shows the sled of FIG. 1, but with the auxiliary pad in a second position.

With reference, first, to FIGS. 1 and 2, a first embodiment of a blocking sled is generally designated by the reference numeral 10 and includes a sled 11 to which is mounted a frame 13. A first main pad 15 is mounted to the frame with a non-circular cross-section rod 17 reciprocating within a corresponding sleeve 19. Within the sleeve 19, a compression spring (not shown) is provided that causes the pad 15 to extend to its greatest extent forward of the sled 11 when it is not being engaged by a blocker. The main pad has a front surface 16.

A second horizontally elongated auxiliary pad 20, as seen in FIG. 1, in a first position thereof overlies and extends forward of the front surface 16 of the main blocking pad 15. The auxiliary blocking pad 20 is mounted on an angular support 21 to the frame 13 of the inventive sled 10. The actuator for the support 21 includes a circular cross-section sleeve 23 and a rod 25 sliding in the sleeve and biased toward a position at which the support 21 is latched as will be explained in greater detail hereinafter in the position shown in FIG. 1.

FIG. 2 shows the same structure as FIG. 1 except that the auxiliary pad 20 has been pivoted upward and rearward of the main pad 15 through actuation of the actuator 23, 25 as will be explained in greater detail hereinafter.

Figure 3:
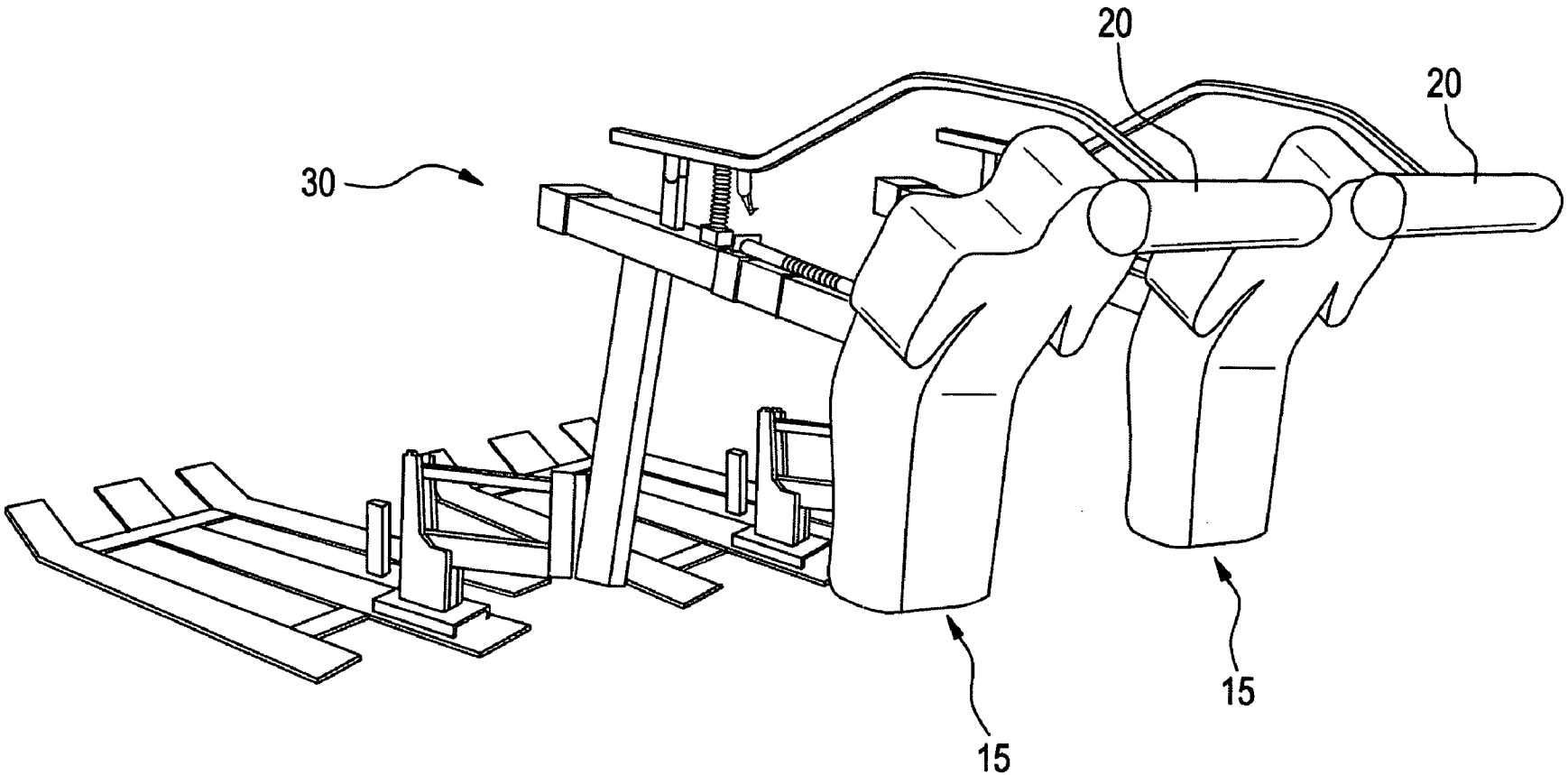
FIG. 3 shows a blocking sled having multiple blocking stations and the auxiliary pads thereof in the first position.
Figure 4:
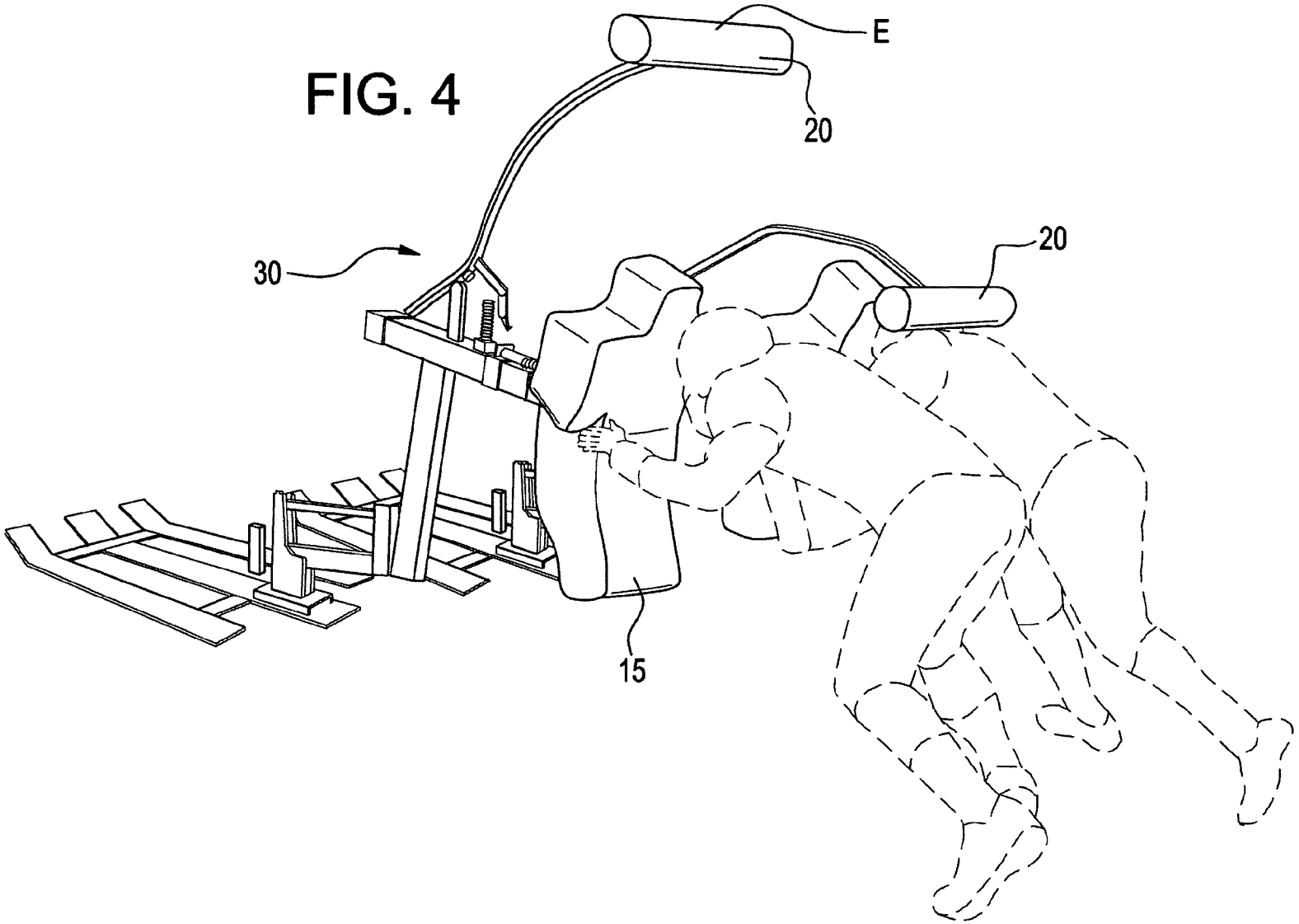
FIG. 4 shows a blocking sled like that of FIG. 3, but with one of the auxiliary pads in its second position.
Figure 5:
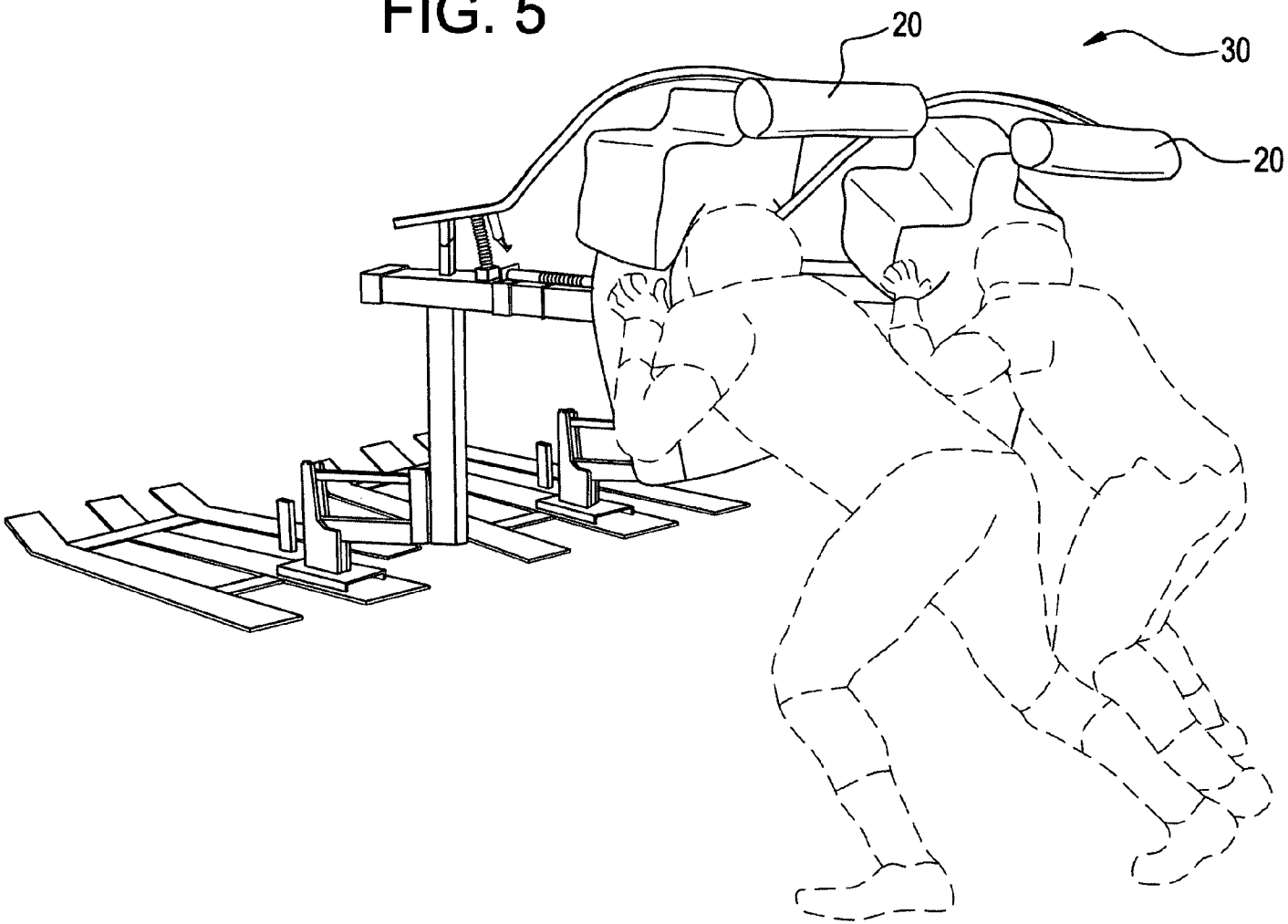
FIG. 5 shows the blocking sled of FIGS. 3 and 4 with both stations with their auxiliary pads in the first position and the players beginning to lift up on the pads.

With reference to FIGS. 3-5, a second embodiment of blocking sled in accordance with the teachings of the present invention is generally designated by the reference numeral 30. The blocking sled 30 includes a plurality of stations, each of which includes a main blocking pad 15 and an auxiliary blocking pad 20. This is to be contrasted with the embodiment of FIGS. 1-2 identified by the reference numeral 10 in which only a single station including a main blocking pad 15 and an auxiliary blocking pad 20 is provided. With reference to FIG. 3, in the position shown, each auxiliary pad is in the first position thereof. In FIG. 4, in the position shown, each auxiliary blocking pad is in the second position and players are engaging the main blocking pads 15, and the left hand main blocking pad 15 has been retracted rearwardly sufficiently to actuate the latch release of the auxiliary pad 15 which has now pivoted upwardly and rearwardly. In FIG. 5, both auxiliary pads are in the first position and the players are driving the pads 15 rearwardly in anticipation of release of the auxiliary pads to the position show in FIG. 2 and in the left side of FIG. 4.

With reference now to FIGS. 6-12, an explanation will now be given concerning the structure and manner of operation of the actuator for the auxiliary pad 20.

As seen in particular in FIGS. 6-10, the support arm 21 for the auxiliary pad 20 is pivoted with respect to the frame at the pivot 41. A biasing means comprising spring 43 engages between the support arm 21 and a spring support 45 to tend to move the support arm in a clockwise direction in the view of FIG. 6. The pivot 41 is mounted on a bracket 42 affixed to the frame 13.

A further bracket 47 depends downwardly from the support arm 21 and carries a hook 49 that includes a ramp surface 51 and a pointed hook end 53. A catch 55 includes an opening 57 (FIGS. 8 and 11-12) that is sized to releasably receive the end of the hook 49 as particularly shown in FIGS. 11 and 12.

A sleeve 61 is mounted to the frame 13 and is aligned with the opening 57 in the catch 55. The sleeve reciprocably receives the distal end of a rod 63 that has a bracket 65 at its proximal end that facilitates attachment to a rear surface of the main pad 15 or its mounting bracket.

Figure 6:
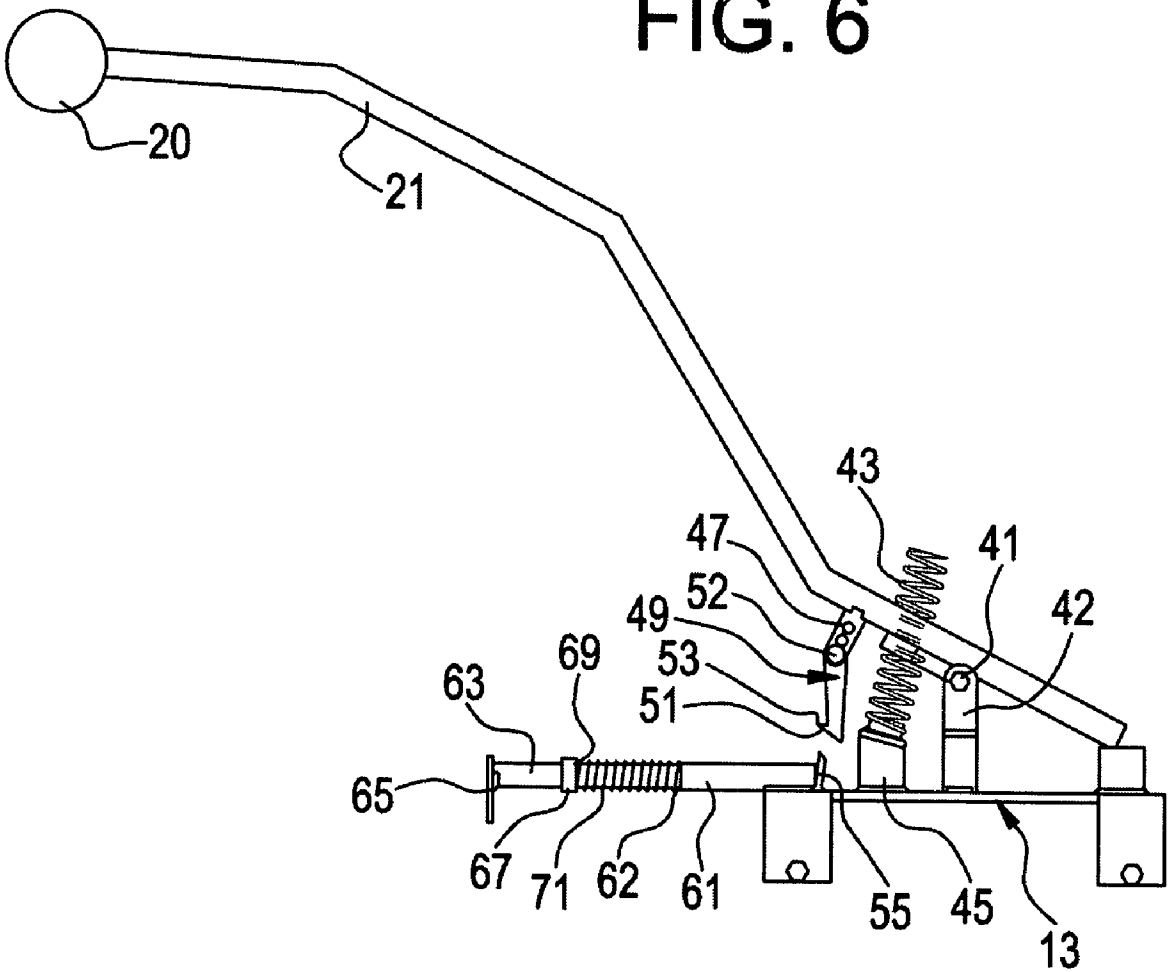
FIG. 6 shows a side view of the actuator mechanism for the auxiliary pad.
Figure 8:
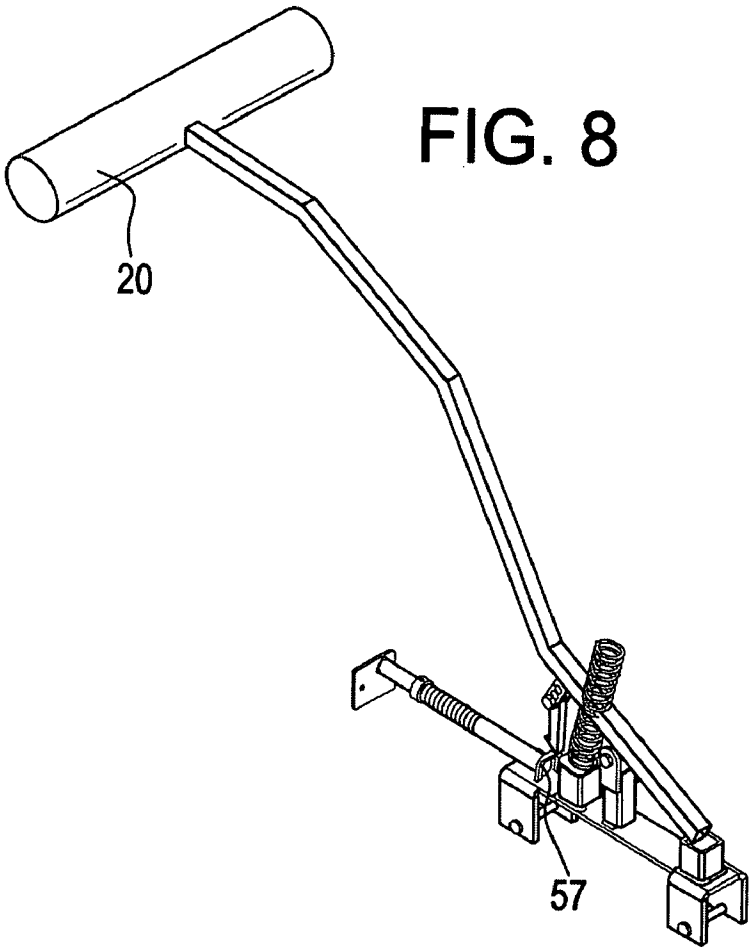
FIG. 8 shows a further perspective view of the auxiliary pad and its actuator.
Figure 7:
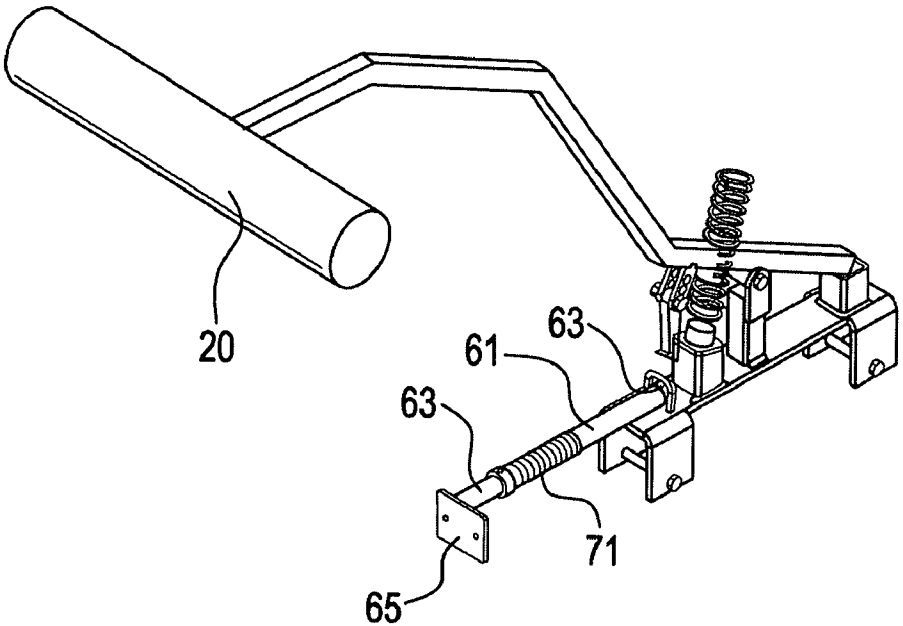
FIG. 7 shows a perspective view of the auxiliary pad and its actuator.
Figure 9:
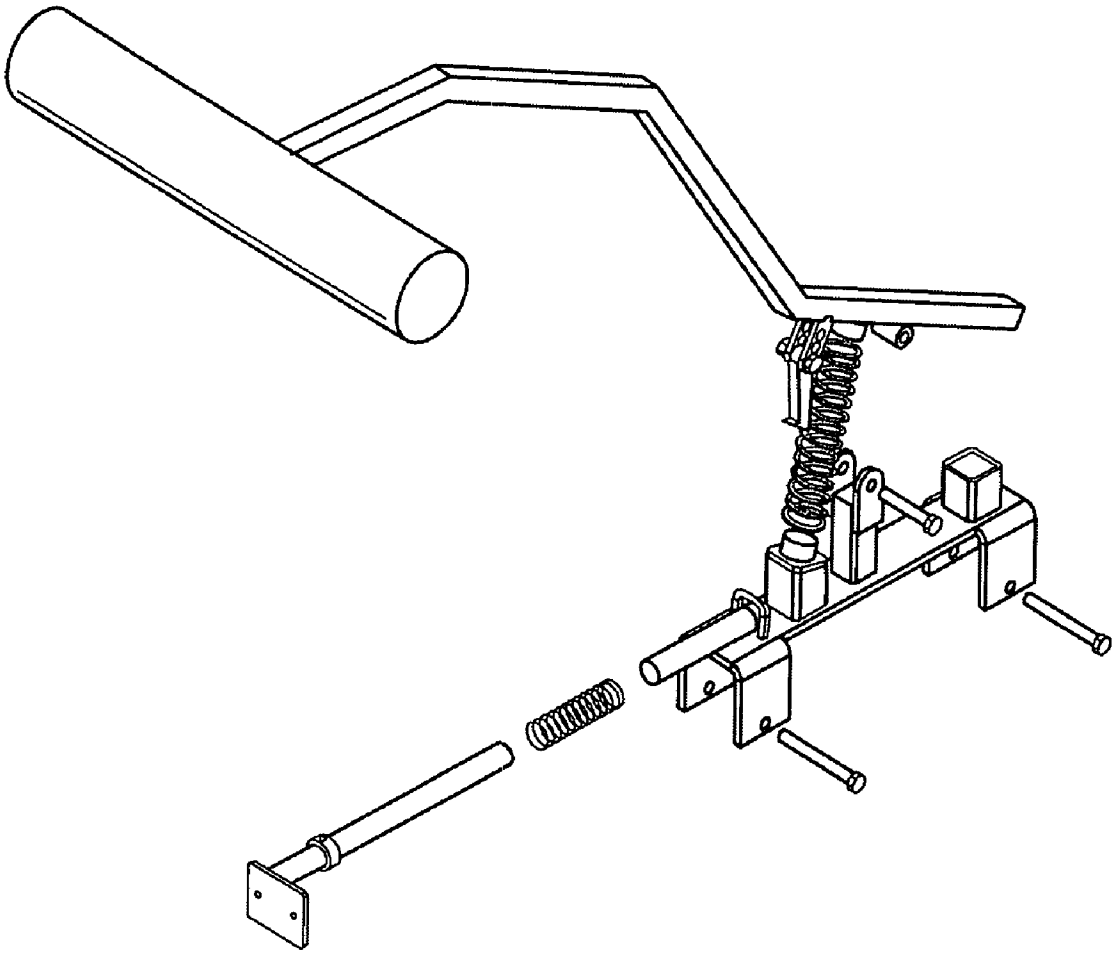
FIG. 9 shows an exploded perspective view of the auxiliary pad and its actuator.
Figure 10:
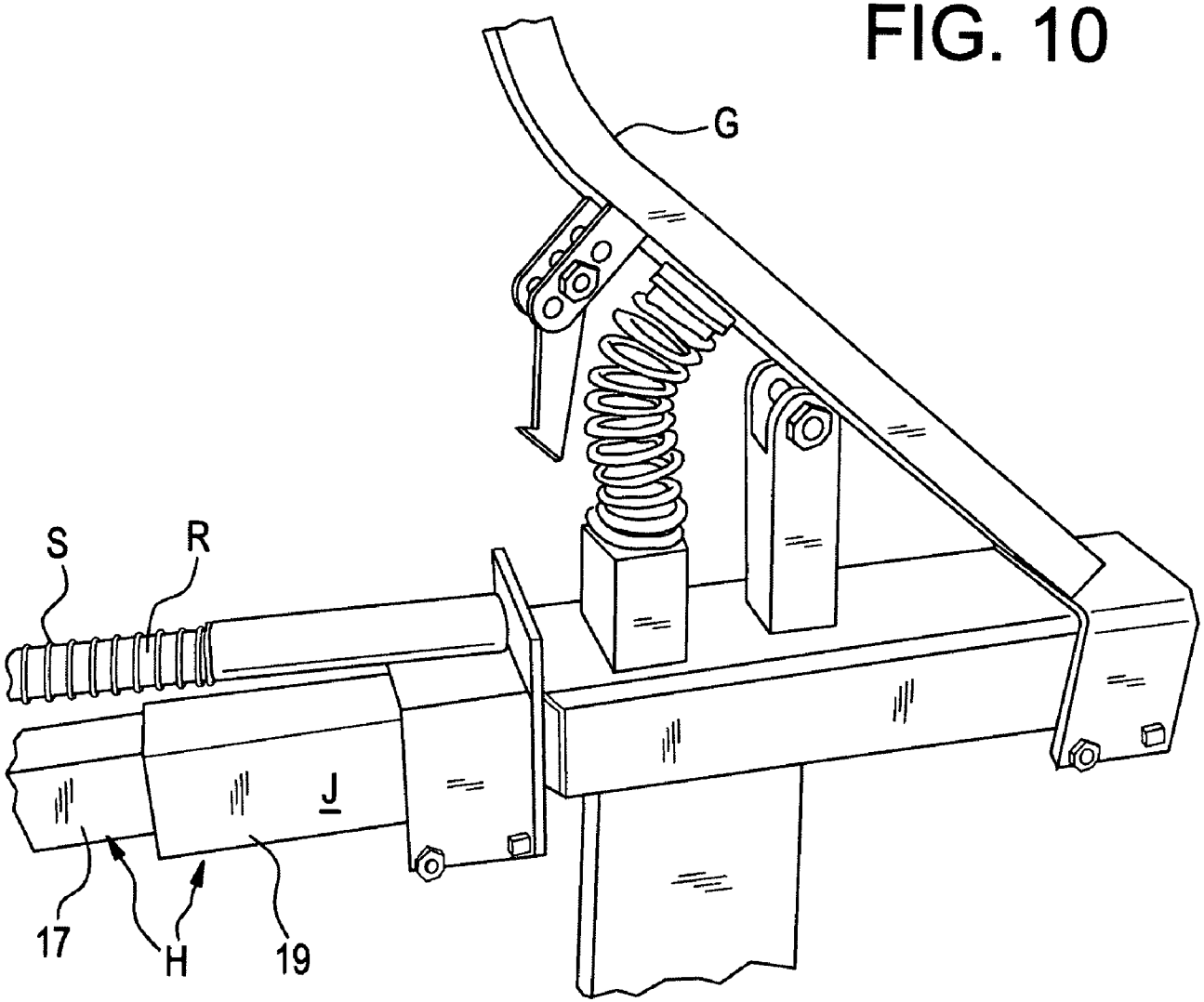
FIG. 10 shows a side view of the actuator with the auxiliary pad showing details of the actuator rod therefor.

As seen in particular in FIGS. 6, 7 and 10, the rod 63 has a fitting 67 fixedly mounted thereon that provides a shoulder 69 that receives one end of a compression spring 71, the other end of which bears against the end 62 of the sleeve 61. In this way, the rod 63 is biased in the left hand direction in the view of FIG. 6.

As should be understood, the end of the rod 63 remote from the bracket 65 is sized and configured to be able to extend through the opening 57 of the catch 55. This is seen, for example, with reference to FIG. 7.

FIG. 10 shows the non-circular cross-section sleeve 19 and the correspondingly cross-sectioned rod 17 that is mounted to a rear surface of the pad 15 or its mounting bracket adjacent to the location of mounting of the rod 63 thereto by the bracket 65.

Figure 12:
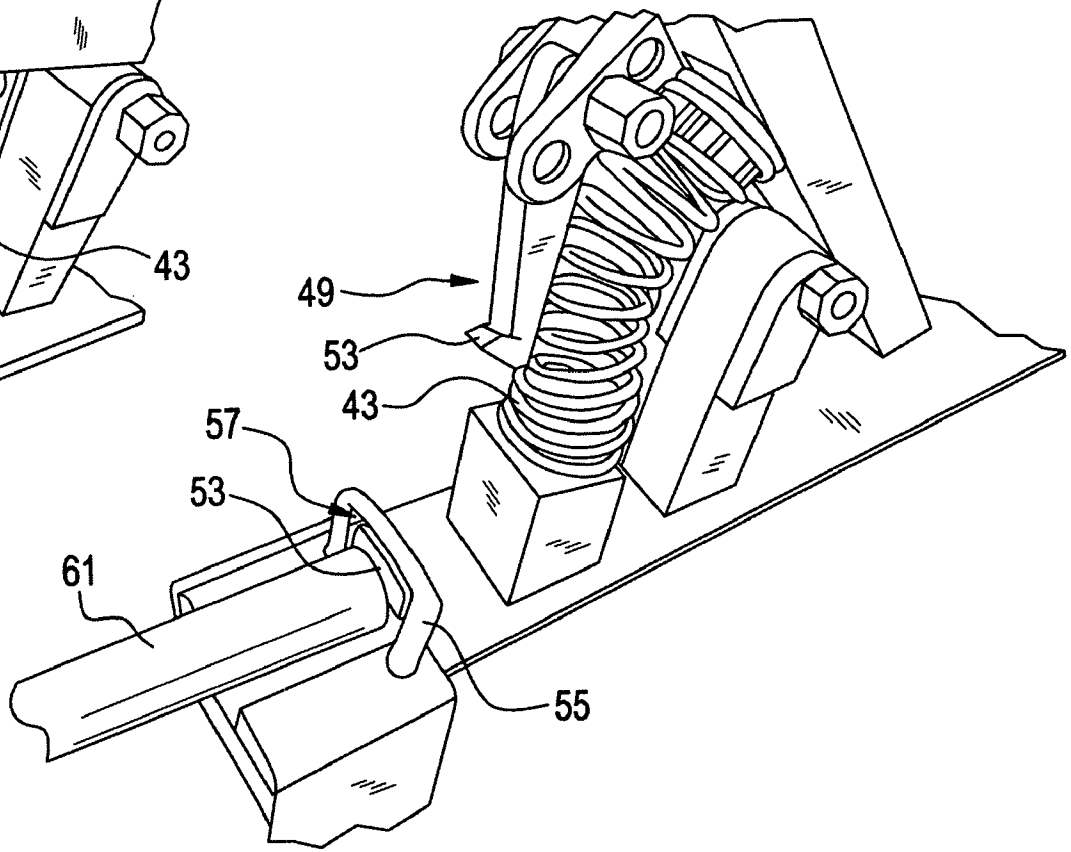
FIG. 12 shows the actuator for the auxiliary pad in the unlatched position.
Figure 11:
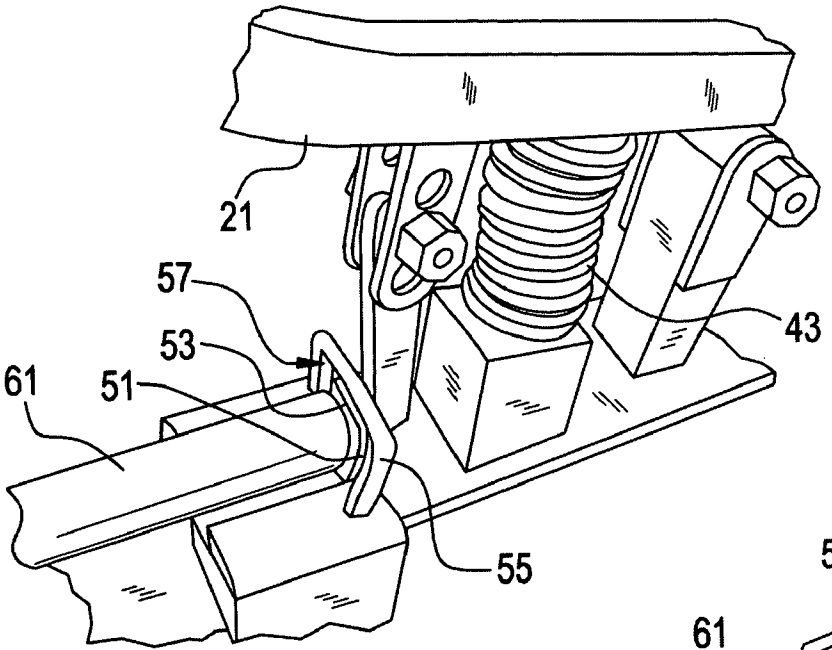
FIG. 11 shows the actuator for the auxiliary pad in the latched position.

With reference to FIGS. 11 and 12, the operation of the actuator for the auxiliary pad 20 will be better understood. FIG. 11 shows the support arm 21 in the position at which the coil spring 43 is completely compressed and the hook 49, 53 is received within the opening 57 of the catch 55. In the position shown in FIG. 11, the rod 63 is in the position shown, for example, in FIG. 6, with the coil compression spring 71 fully extended as shown. When it is desired to release the latch hook 49 from the catch 55 opening 57, a user strikes the pad 15 and begins to move it rearwardly. As the pad 15 moves rearwardly, the rod 63 begins to move against the force of the compression spring 71. When the end of the rod 63 protrudes into the opening 57 of the catch 55, this moves the hook 49 which pivots about the pivot 52 (FIG. 6) to release the hook 49 from the opening 57. When this occurs, the compression spring 43 expands (FIG. 12) and thereby pivots the support arm 21 about the pivot 41 (FIG. 6) to move the auxiliary pad 20 to the position shown in FIG. 2.

After this has occurred, once the main pad 15 has been released so that it expands out to its rearward-most position, the user may pivot the support 21 downwardly by grabbing the support 21 or the pad 20 and pulling them down until the hook 49 is in position to enter the opening 57 and the catch 55 to lock the position of the auxiliary pad 20 in the position shown in FIG. 1. After this has occurred, the process may be repeated with a player striking the pad 15 while maintaining their center of gravity low given the location of the auxiliary pad 20. Again, when the main pad 15 has been reciprocated rearwardly a sufficient distance, the distal end of the rod 63 enters the opening 57 in the catch 55, engages the hook 49, pivots it about the pivot 52, and thereby releases the support arm 21 which pivots upwardly and rearwardly about the pivot 41 to the position shown, for example, in FIG. 2.

In the preferred embodiment of the present invention, the component parts thereof are made of strong, durable materials such steel and aluminum. As explained above, a blocking sled may include one combination main pad 15 auxiliary pad 20 or a plurality of such combinations.

As such, an invention has been disclosed in terms of preferred embodiments thereof which fulfill each and every one of the objects of the invention as set forth hereinabove and provide a new and useful blocking sled with pivotable auxiliary pad of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A blocking apparatus, comprising:

a) a frame supporting a first pad for movement between a first extended position and a second retracted position;

b) a second pad attached to said frame via an elongated arm, said second pad being movable between a first position at which it is located above and forward of a front surface of said first pad in its extended position, and a second position at which it is located above and rearward of said first pad front surface in its retracted position;

c) a latch retaining said second pad in its first position;

d) an actuator movable with said first pad and operable to release said latch when said first pad is in said second retracted position; and e) biasing means for moving said second pad to said second position thereof when said actuator has released said latch.

2. The blocking apparatus of claim 1, wherein said movement of said first pad is linear.

3. The blocking apparatus of claim 1, wherein movement of said second pad between its first and second positions comprises pivoting movement.

4. The blocking apparatus of claim 2, wherein movement of said second pad between its first and second positions comprises pivoting movement.

5. The blocking apparatus of claim 1, wherein said second pad is horizontally elongated.

6. The blocking apparatus of claim 1, wherein said frame is mounted on a sled.

7. The blocking apparatus of claim 6, wherein said frame supports a plurality of first pads and a corresponding plurality of second pads.

8. The blocking apparatus of claim 1, wherein said actuator comprises an elongated rod attached to a rear surface of said first pad, said elongated rod reciprocating when said first pad moves between its first and second positions.

9. The blocking apparatus of claim 8, wherein said actuator rod is biased to movement toward said first position of said first pad.

10. The blocking apparatus of claim 9, wherein said frame includes a catch having an opening receiving an end of said rod when said first pad is in said second position thereof.

11. The blocking apparatus of claim 10, wherein said latch comprises a hook attached to said elongated arm and received in said opening in said first position of said second pad.

12. The blocking apparatus of claim 11, wherein said hook is released from said opening when said end of said rod enters said opening.

13. The blocking apparatus of claim 12, wherein said biasing means comprises a first spring.

14. The blocking apparatus of claim 13, wherein said actuator rod is biased toward said first position of said first pad by a second spring.

15. The blocking apparatus of claim 1, wherein said biasing means comprises a first spring.

16. The blocking apparatus of claim 1, wherein said latch comprises a hook.

17. A blocking apparatus, comprising:

a) a frame mounted on a sled and supporting a first pad for linear movement between a first extended position and a second retracted position;

b) a second pad attached to said frame via an elongated arm, said second pad being pivotable between a first position at which it is located above and forward of a front surface of said first pad in its extended position, and a second position at which it is located above and rearward of said first pad front surface in its retracted position;

c) a latch comprising a hook retaining said second pad in its first position, said hook received in an opening in a catch mounted on said frame in said first position of said second pad;

d) an actuator movable with said first pad and operable to release said latch from said catch when said first pad is in said second retracted position; and e) spring biasing means for moving said second pad to said second position thereof when said actuator has released said latch.

18. The blocking apparatus of claim 17, wherein said actuator comprises an elongated rod attached to a rear surface of said first pad, said elongated rod reciprocating when said first pad moves between its first and second positions, said catch opening receiving an end of said rod when said first pad is in said second position thereof, said hook being released from said opening when said end of said rod enters said opening.

19. The blocking apparatus of claim 18, wherein said spring comprises a first spring, and said actuator rod is biased toward said first position of said first pad by a second spring.

20. The blocking apparatus of claim 17, wherein said second pad is horizontally elongated.

* * * * *